US005915917A

United States Patent [19]

Eveker et al.

[11] Patent Number: 5,915,917

[45] Date of Patent: Jun. 29, 1999

[54] COMPRESSOR STALL AND SURGE CONTROL USING AIRFLOW ASYMMETRY MEASUREMENT

[75] Inventors: Kevin M. Eveker, Marlborough; Daniel L. Gysling, Glastonbury; Carl N. Nett, Tolland; Hua O. Wang, Willington, all of Conn.

[73] Assignee: United Technologies Corporation, Hartford, Conn.

[21] Appl. No.: 08/676,387

[22] PCT Filed: Nov. 2, 1995

[86] PCT No.: PCT/US95/17145

§ 371 Date: Nov. 2, 1995

§ 102(e) Date: Nov. 2, 1995

[87] PCT Pub. No.: WO97/00381

PCT Pub. Date: Jan. 3, 1997

Related U.S. Application Data

[63] Continuation-in-part of application No. 08/355,763, Dec. 14, 1994, abandoned.

[51] Int. Cl.[6] ..... F01D 17/08

[52] U.S. Cl. ..... 415/1; 415/17; 415/27; 60/39.29

[58] Field of Search ..... 415/1, 17, 26, 415/27, 28, 118; 60/39.29; 701/102, 103, 106

[56] References Cited

U.S. PATENT DOCUMENTS 4,550,564 11/1985 Callahan et al. ..... 60/39.093
5,340,127 8/1994 Freeman et al. ..... 415/1

FOREIGN PATENT DOCUMENTS 401211696 8/1989 Japan ..... 415/26

*Primary Examiner*—Edward K. Look
*Assistant Examiner*—Richard S. Woo
*Attorney, Agent, or Firm*—John Swiatocha

[57] ABSTRACT

A technique for controlling compressor stall and surge is disclosed. In a gas turbine engine, static pressure asymmetry is sensed at a plurality of locations along the circumference of the compressor inlet. Time rate of change of the mass flow in the compressor is also estimated using pressure measurements in the compressor. A signal processor uses these signals to modulate a compressor bleed valve responsive to the level of flow property asymmetry, the time rate of change of the annulus average flow to enhance operability of the compressor.

32 Claims, 9 Drawing Sheets

SMALL AMPLITUDE CIRCUMFERENTIAL TRAVELLING WAVES:

LARGE AMPLITUDE NONLINEAR "ROTATING STALL" CELL:

FUEL COMMAND
41
PLA
FADEC
42
STATIC PRESSURE SENSOR(50)
40
ACON
SP
49
BLEED VALVE
46
48
Sa1-San
Sb1-Sbn
9
9
44

COMPRESSOR STALL AND SURGE CONTROL USING AIRFLOW ASYMMETRY MEASUREMENT

This application has been filed under 35 U.S.C. 371 based on PCT/US95/17145 filed on Nov. 2, 1995, which is a CIP of earlier application Ser. No. 08/355,763, now abandoned.

TECHNICAL FIELD

This invention relates to techniques for detecting and controlling dynamic compressor stall and surge, for instance in gas turbine engines.

BACKGROUND OF THE INVENTION

In a dynamic compressor operating under normal, stable flow conditions, the flow through the compressor is essentially uniform around the annulus, i.e. it is axisymmetric, and the annulus-averaged flow rate is steady. Generally, if the compressor is operated too close to the peak pressure rise on the compressor pressure rise versus mass flow, constant speed performance map, disturbances acting on the compressor may cause it to encounter a region on the performance map in which fluid dynamic instabilities, known as rotating stall and/or surge, develop. This region is bounded on the compressor performance map by the surge/stall line. The instabilities degrade the performance of the compressor and may lead to permanent damage, and are thus to be avoided.

Rotating stall can be viewed as a two-dimensional phenomena that results in a localized region of reduced or reversed flow through the compressor which rotates around the annulus of the flow path. The region is termed "stall cell" and typically extends axially through the compressor. Rotating stall results in reduced output (as measured in annulus-averaged pressure rise and mass flow) from the compressor. In addition, as the stall cell rotates around the annulus it loads and unloads the compressor blades and may induce fatigue failure. Surge is a one-dimensional phenomena defined by oscillations in the annulus-averaged flow through the compressor. Under severe surge conditions, reversal of the flow through the compressor may occur. Both types of instabilities should be avoided, particularly in aircraft applications.

In practical applications, the closer the operating point is to the peak pressure rise, the less the compression system can tolerate a given disturbance level without entering rotating stall and/or surge. Triggering rotating stall results in a sudden jump (within 1–3 rotor revolutions) from a state of high pressure rise, efficient, axisymmetric operation to a reduced pressure rise, inefficient, non-axisymmetric operation. Returning the compressor to axisymmetric operation (i.e., eliminating the rotating stall region) requires lowering the operating line on the compressor performance map to a point well below the point at which the stall occurred. In practical applications, the compressor may have to be shut down and restarted to eliminate (or recover from) the stall. This is referred to as stall hysteresis. Triggering surge results in a similar degradation of performance and operability.

As a result of the potential instabilities, compressors are typically operated with a "stall margin". Stall margin is a measure of the ratio between peak pressure rise, i.e. pressure rise at stall, and the pressure ratio on the operating line of the compressor for the current flow rate. In theory, the greater the stall margin, the larger the disturbance that the compression system can tolerate before entering stall and/or surge.

Thus, the design objective is to incorporate enough stall margin to avoid operating in a condition in which an expected disturbance is likely to trigger stall and/or surge. In gas turbine engines used to i power aircraft, stall margins of fifteen to thirty percent are common. Since operating the compressor at less than peak pressure rise carries with it a reduction in operating efficiency and performance, there is a trade-off between stall margin and performance.

DISCLOSURE OF THE INVENTION

An object of the present invention is to control stall and surge in a compressor.

According to the present invention, the change in the level of circumferential flow asymmetry is detected along with the time rate of change of the inlet (annulus) average flow to control compressor bleed flow, thereby modulating total compressor flow.

According to the invention, a circumferential spatial pattern or other measure of asymmetry of the compressor flow is determined from a plurality of compressor inlet sensors, and the pattern is resolved into a first term representative of a level of asymmetry in the flow properties that is summed with a second term that represents the time rate of change in the average compressor flow.

According to one aspect of the invention the first term is proportional to the first spatial Fourier coefficient |SFC1|, indicative of the level of asymmetry of the circumferential gas flow properties.

According to another aspect of the invention, the first term is proportional to the square of the first spatial Fourier coefficient |SFC1|. The second term is proportional to the time rate of change of total compressor flow, determined, for example, from pressure sensors in the compressor flow path. The two signals are scaled and summed to produce a bleed control signal $A_{con}$, as expressed by $A_{con}=k_1\alpha+k_2\delta$, where $A_{con}$ is the area, $\alpha$ is $|SFC1|^2$ and $\delta$ is the time rate of change of the annulus averaged mass flow.

According to one aspect of the invention, an integral term is added to the sum of the two terms which represents the temporal integral of the difference between the instantaneous level of asymmetry and a maximum desired level for the compressor.

According to another aspect of present invention, the magnitude of the integral term will range between two limiting values (min/max).

A feature, of a particular embodiment of the present invention, is the use of arrays of pressure sensors to sense the flow properties within the flow path, rather than making direct flow measurements. Direct flow measurement devices are generally less reliable than pressure measurement devices, and much more difficult to implement in a real world application. Pressure sensors are more easily incorporated into a control system that must operate in a harsh environment.

The stall and surge controller of the present invention has application to any compression (pumping) system that includes a compressor subject to the risk of rotating stall and/or surge. Examples include gas turbine engines and cooling systems, such as some air conditioning systems or refrigeration systems. The invention has application to a variety of types of compressors, including axial flow compressors, industrial fans, centrifugal compressors, centrifugal chillers, and blowers.

Another feature of the present invention, is that the bleed system responds to both the asymmetric flow properties and flow properties representative of the time rate of change of the annulus averaged flow, thus combining the characteristics of rotating stall and surge phenomena as inputs to the controller.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
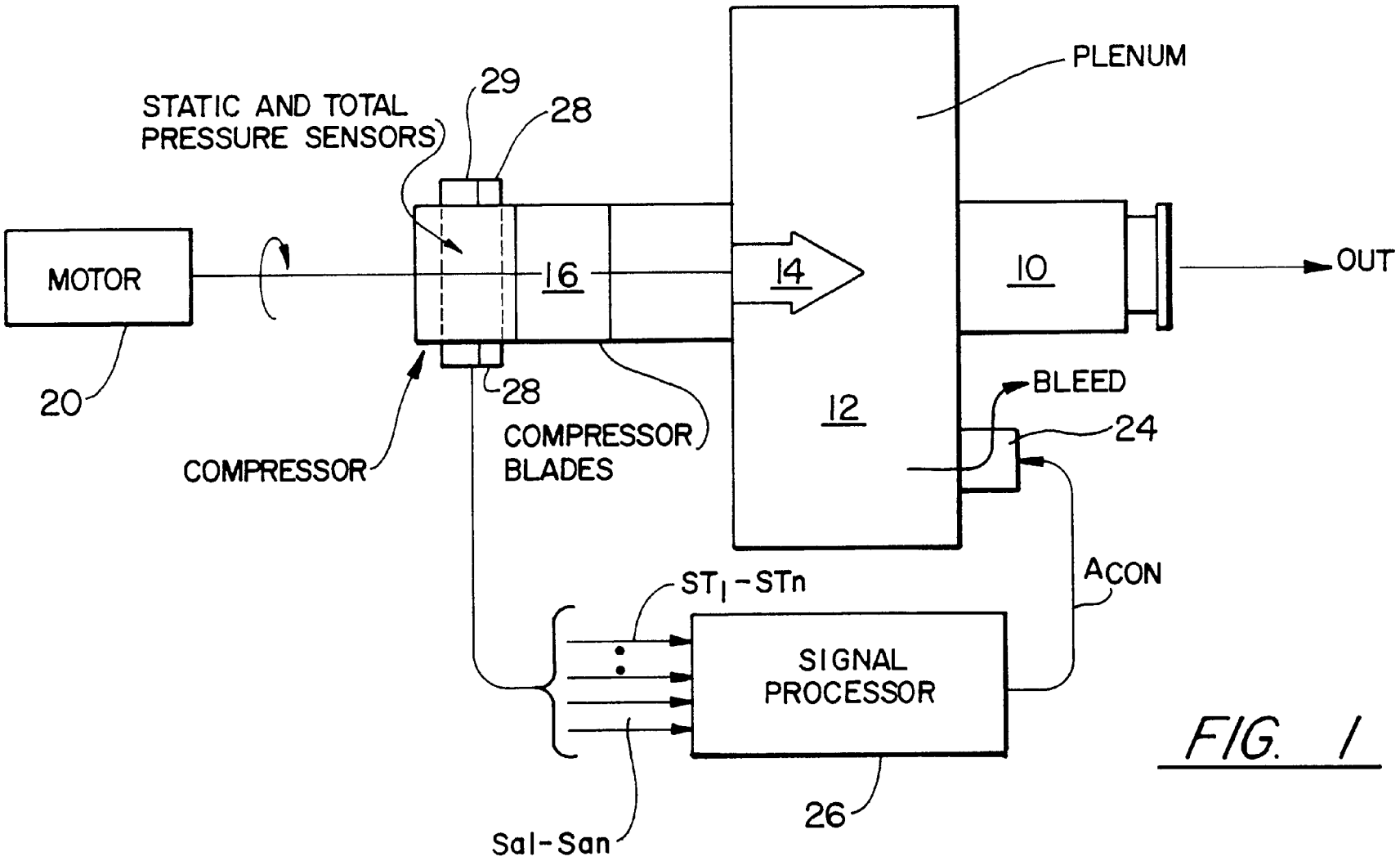
FIG. 1 is a functional block diagram showing a motor driven dynamic compressor with a stall control system embodying the present invention.

FIG. 1 illustrates a simple test system capable of varying outlet flow from a flow restricting valve 10. It should be appreciated, that this system has relevant compression system dynamics comparable to a gas turbine engine. The plenum 12 receives the compressed flow from the axial compressor blades 16, which are rotated by a motor 20. A servo controlled bleed valve 24, also allows flow from the plenum, but its flow area is controlled by a signal processor 26 which commands a position control signal $A_{con}$. The signal processor 26 receives a plurality of pressure signals from one or more total pressure sensors 28 and/or static pressure sensors 29, as described below.

According to the present invention, the signal processor 26 operates according to the control law:

$$A_{con}=K_1\alpha+K_2\delta \quad (1)$$

wherein $\alpha$=instantaneous level asymmetry in flow properties, $\delta$=the time rate of change of annulus average mass flow, and $K_1$, $K_2$=gain constants.

Thus, the signal processor 26 calculates the control area $A_{con}$ of the bleed valve 24 as the sum of the two terms reflective of the instantaneous asymmetry of the gas flow and the time rate of change of the annulus average mass flow.

The asymmetry function may be determined by a variety of methods and means, most of which require a plurality of circumferentially disposed sensors in the gas flow and capable of measuring gas flow properties indicative of flow asymmetry. In some cases, it may be possible to discern the level of asymmetry from a single sensor, given sufficient familiarity with the system. According to one embodiment of the present invention, $\alpha$ is determined by an array of static pressure sensors 29 disposed about the circumference of the compressor inlet, as shown in FIG. 1 The outputs of the static sensors, Sal-San are used to calculate a first spatial Fourier coefficient, SFC1, which provides an mathematical representation of the flow asymmetry. Other representations of this asymmetry may be calculated, for example, by spatially averaging the sensor inputs and determining a spatial root mean square (RMS) of the variation of the sensor outputs around the annulus, or by other methods that may provide a useful valuation of flow asymmetry. In this embodiment of the invention, it has been found preferable to set a equal to the amplitude of $SFC1^2$.

The second term is proportional to the time rate of change of the annulus average mass flow, $\delta$. In the embodiment illustrated in FIG. 1, $\delta$ is calculated by the signal processor 26 from a plurality of total pressure signals ST1-STN taken by the pressure sensor 29 and At he processor 26 determines the time rate of change of the annulus average flow. It should be appreciated that one probe may be used to provide a signal indicative of average mass flow if the compressor flow characteristics are suitable. The actual sensor arrangement/method of measuring the gas flow characteristics in the compressor may be any of a number of methods that may occur to one of ordinary skill in the art of flow measurement, including, but not limited to, hot wire anemometers, axially spaced differential static pressure taps, etc.

The signal processor 26 sums the terms $K_1\alpha$ and $K_2\delta$, to determine $A_{con}$, the desired bleed valve open area. The gain constants $K_1$, $K_2$ are selected based on the particular physical and mathematical relationship of the compressor and control signals, according to known control practice. It should be appreciated that $K_2$ may be negative while $K_1$ will always be positive.

During normal compressor operations, gas flow asymmetry is comparatively low, and the annular average mass flow is relatively constant, thus both $\alpha$ and $\delta$ are very small and the bleed valve control signal $A_{con}$ commands an essential shut bleed valve. As the compressor is operated beyond the stall line without stall control, the flow asymmetry value a will increase to performance-limiting levels. With stall control signal processor 26 will thus command the bleed valve 24 to open, increasing overall compressor gas flow and, effectively, maintaining compressor operability.

Signal processor 26 will also receive signals indicating an increased fluctuation in the annulus average mass flow. These fluctuations, represented by $\delta$ in the above control law, will also drive the bleed valve to open, or shut, thereby modulating total compressor flow to maintain compressor stability.

Figure 5:
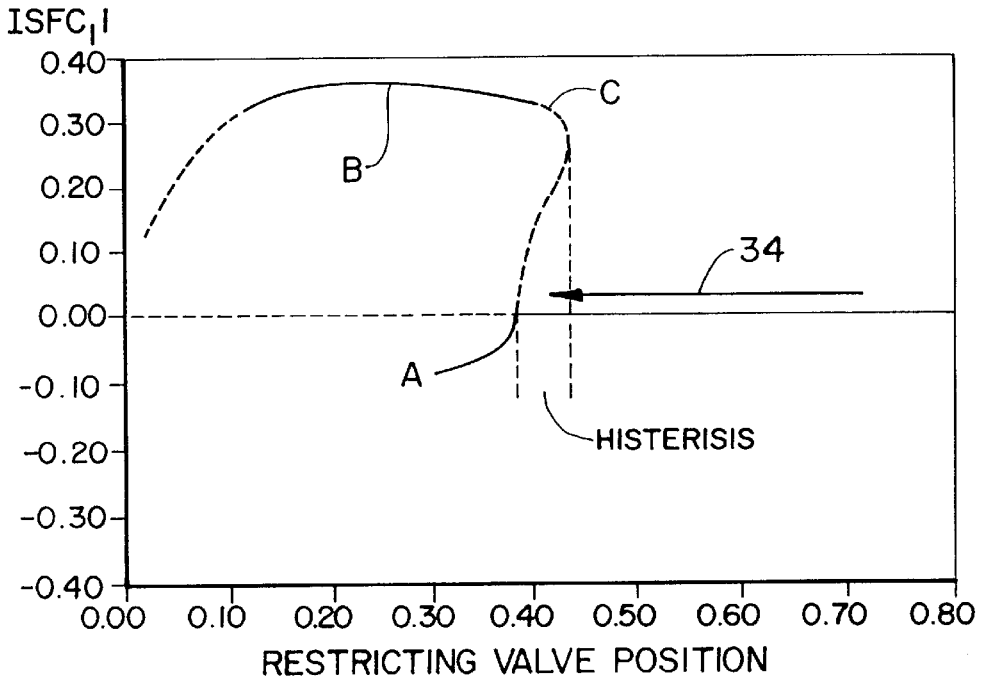
FIG. 5 is diagram showing the level of pressure asymmetry (indicated by the value of the first Fourier coefficient) as a function of flow restriction in a compressor without a stall control system.
Figure 6:
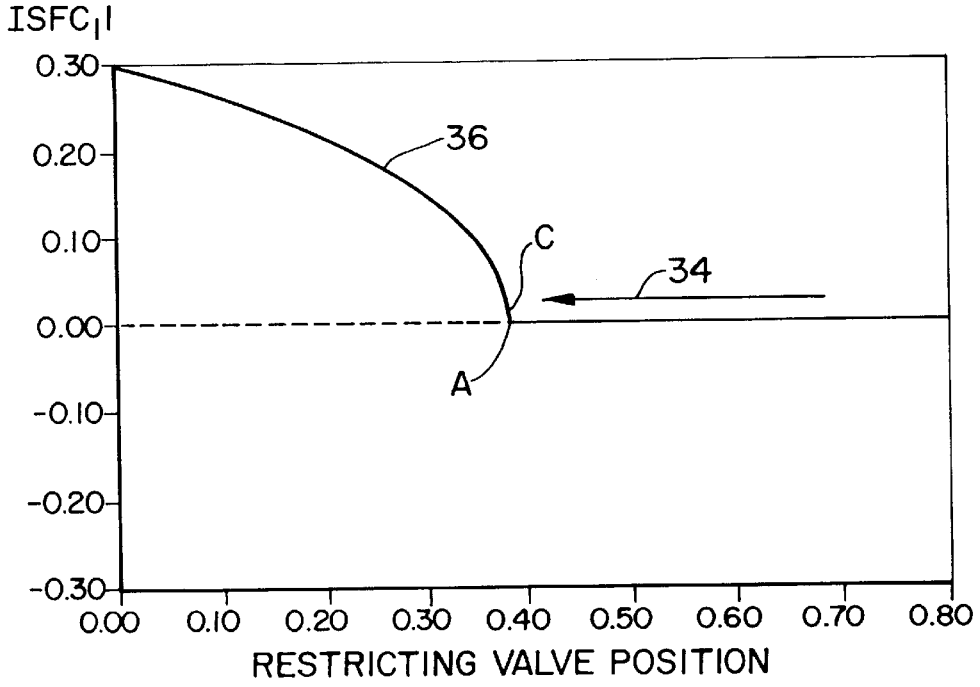
FIG. 6 is a diagram of the same compressor system used in FIG. 5, but for a compressor that bleeds compressor flow as a function of $|SFC1|^2$ and the annulus averaged time rate of change of compressor flow.

The effect of the signal processor-bleed valve operating according to the two-term control law (equation 1) is apparent by the comparison of FIGS. 5 and 6. FIG. 5 shows the response of an uncontrolled compression system in which a variable outlet flow restriction is used. As the flow restriction is shut, thus driving the compressor toward stall conditions, the calculated flow asymmetry, shown here as SFC1, jumps from the normal operating level near 0, shown on line 34, to a high value C from the onset of stall at A. Furthermore, significant hysteresis is exhibited, which must be overcome in order to restore normal engine operation.

FIG. 6 shows the operation of a similar compressor having a bleed valve controller using a signal processor 26 according the embodiment of the invention described above. At the onset of stall, at A, the action of the control is shown to have greatly reduced the increase in flow asymmetry and removed the hysteresis exhibited in FIG. 5. It is clear that the normal engine operation will be immediately and predictably restored by opening the restriction to its value at point A. In actual operation of an axial flow compressor in a gas turbine engine, a bleed control system operating according to the two-term control law will respond quickly to the first development of a stall or surge pattern in the compressor section, opening the bleed valve accordingly to control the growth of instability and maintain stable engine operation.

A third term may be added to the above two-term control law, which acts to open the bleed valve 24 in response to compressor operation under conditions of asymmetry flow in excess of a predetermined threshold value. This additional integral term is represented by the control law as, $K3\int(\alpha k-\alpha 1)dt|_0^{\alpha max}$ where $\alpha_k$ equals a predetermined threshold of flow asymmetry and $\alpha_1$, equals the instantaneous flow asymmetry and K3 equals a gain constant and $a_{max}$ equals a maximum bleed valve open area.

As written, this additional integral term is limited in magnitude between a lower value of zero, and a maximum value of $a_{max}$. Thus, if $\alpha$ is greater than $a_{max}$, the value of the integral term will be not less than zero. If $X_1$ is greater than $\alpha_{k1}$ the integral term will never achieve a value greater than $a_{max}$. In the illustrated embodiment of the present invention this limit is implemented using well known "anti-windup" control logic.

This third integral term recognizes the existence of a small amount of flow asymmetry that is constantly present and monotosly increasing as stall is approached, in a properly operating compressor. By means of the difference between $\alpha_k$ and $\alpha_1$, this term provides a correcting signal only in the event the instantaneous flow asymmetry rises above a threshold value $\alpha_k$, selected as being indicative of minimally desired stall margin. As stated above, flow asymmetry may be evaluated by a variety of methods, one of which is the SFC1 calculation described above. The full control law for this embodiment of the invention, using the integral term, is written as:

$$Acom=K1\alpha 1+K_2\delta+K\,3\int(\alpha k-\alpha 1)dt|_0^{amax} \quad (2)$$

where $\alpha_1$=the instantaneous flow asymmetry, $\delta$=the time rate of change of the annulus average mass flow, K1, K2 and K3 are gain constants, $\alpha_k$ equals a predetermined threshold of flow asymmetry, and $a_{max}$ is a maximum bleed valve area.

In operation, the three terms of the control law operate to effectively reduce the occurrence of stall and surge in a compressor, even when operated under extreme conditions likely to cause stall. The combination of the first and second terms, responsive to the instantaneous flow conditions in the compressor, and the third integral term, responsive to the period of time during which the compressor has operated under a reduced stall margin condition (i.e. above the threshold level of asymmetry), greatly enhances operability and stability of the compressor shown in FIG. 7, by restricting compressor operation to points with asymmetry levels at, or below, the threshold level $\alpha_k$. Thus the controller assures a minimum level of remaining stall margin. Since this controller prohibits operation beyond the uncontrolled stall line, the controller according to the embodiment of the present invention is able to enhance compression system operability with significantly reduced actuator bandwith requirements as compared to the two-term embodiment disclosed above.

Figure 7:
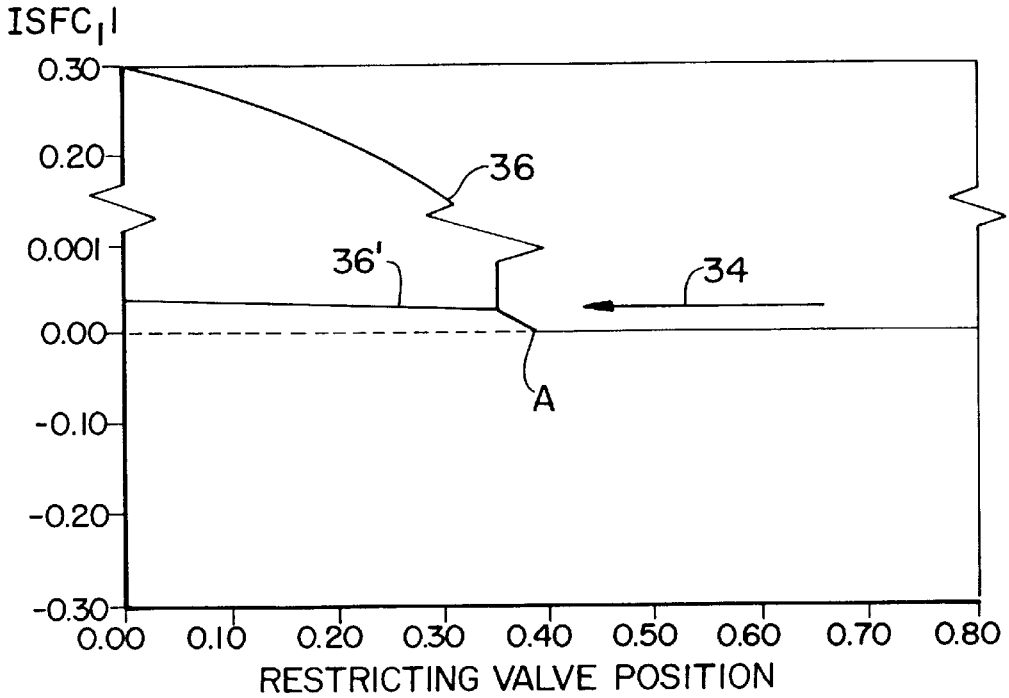
FIG. 7 is a diagram of the same compressor system used in FIG. 6, but for a compressor that bleeds compressor flow as a function of $|SFC1|^2$, the time rate of change mass flow, and the difference between actual $|SFC1|$ and a design value for $|SFC1|$, according to different embodiments of the invention.

As shown in FIG. 7, with the three-term controller the level of asymmetry does not exceed the specified level $\alpha_k$, regardless of the outlet flow restriction or disturbance level, as indicated by line 36'. A compressor operating with a controller according to this three term control law embodiment of the invention is thus, in theory, virtually stall proof in a test system as shown in FIG. 1.

Figure 2A:
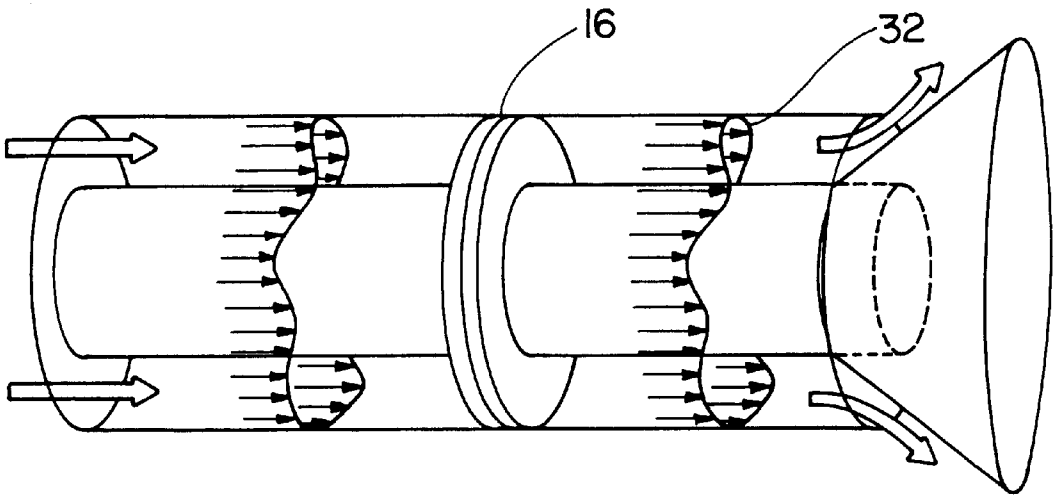
FIGS. 2A and 2B are diagrams showing circumferential variation of axial velocity in an axial compressor under both normal and rotating stall conditions.
Figure 2B:
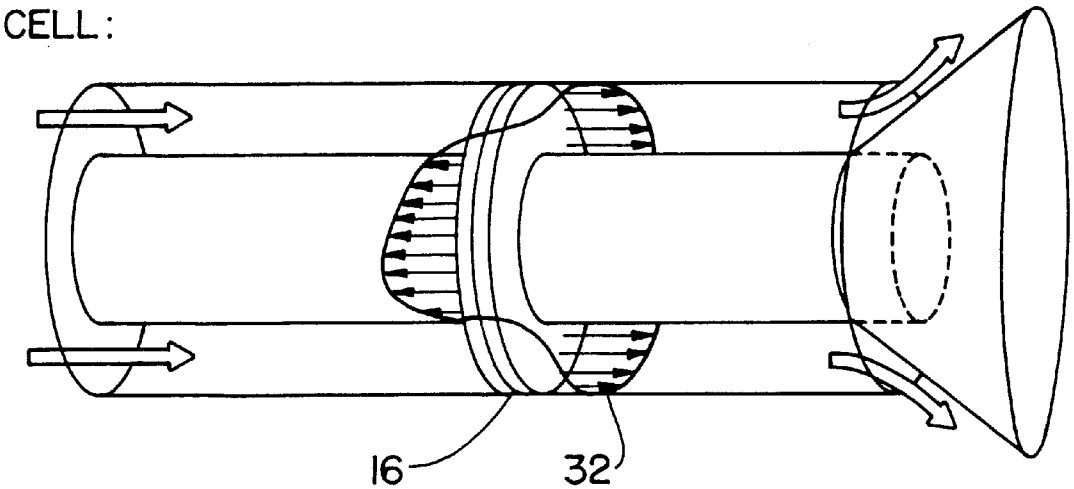
Figure 3A:
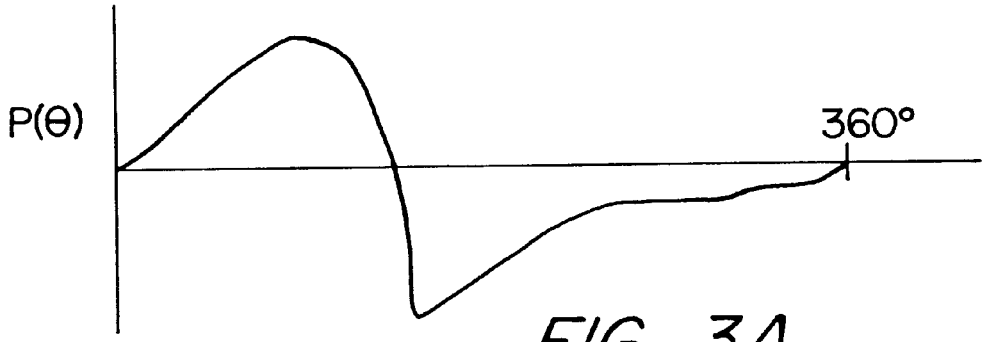
FIG. 3A is a map of gas static pressure versus compressor inlet circumferential position during a rotating stall.
Figure 4:
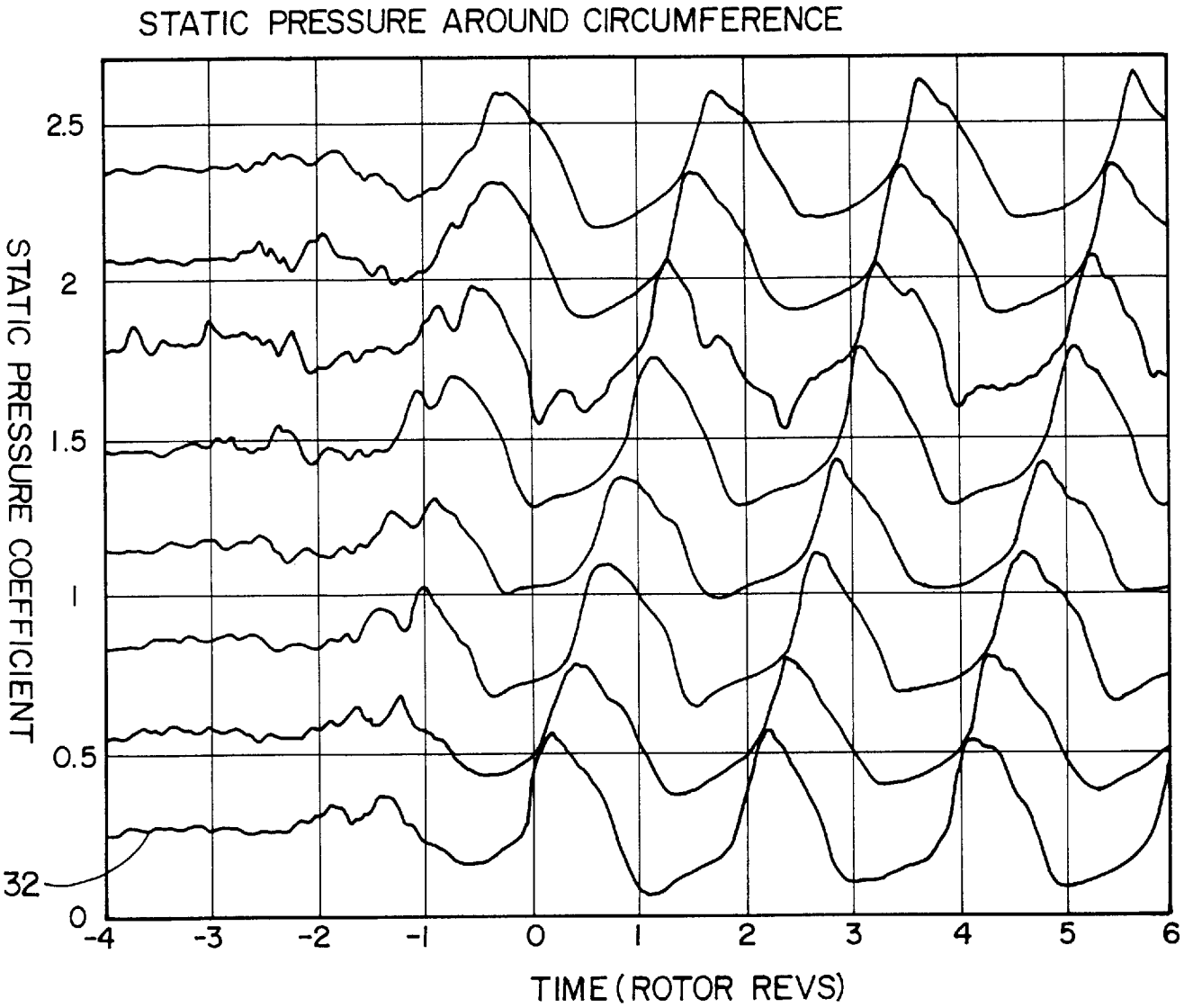
FIG. 4 is a diagram showing the static pressure offset to indicate circumferential position versus compressor revolutions during the development of a rotating stall at eight different circumferential positions in a compressor inlet or annulus.

Observing FIGS. 2A and 2B, illustrates two conditions at the inlet to an axial compressor, where the compressor is depicted schematically as a disk 30. FIG. 2A shows a condition in which there is a small amount of non-performance limiting asymmetry in the axial flow. FIG. 2B shows a similar compressor experiencing performance limiting rotating stall. This is associated with a stall, which when mapped at an instant in time, would appear as shown in FIG. 3A. This pattern rotates around the axis, creating an uneven spatially periodic pressure pattern. FIG. 4 shows a map of the unsteady component of static pressure at eight different circumferential locations for static sensors 29 during a rotating stall from −4 to +6 compressor revolutions offset to show circumferential position during a typical rotating stall inception. The periodic nature of each line 32 should also be noted along with the phase difference of the pressures recorded at each circumferential location indicating a rotating pattern. It should further be noted that the compressor transitions from axisymmetric flow to fully developed stall within a few rotor revolutions.

Figure 3B:
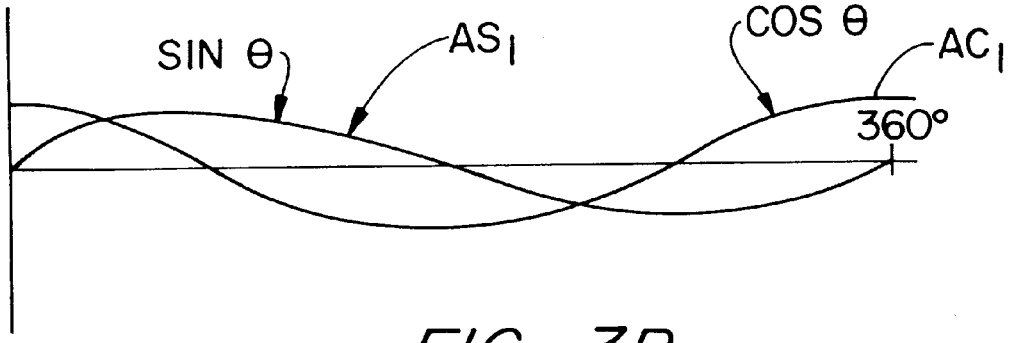
FIGS. 3B, 3C show the first and second harmonic waveforms used with which the spatial Fourier coefficients are computed which represent the general spatial distribution shown in FIG. 3A.
Figure 3C:
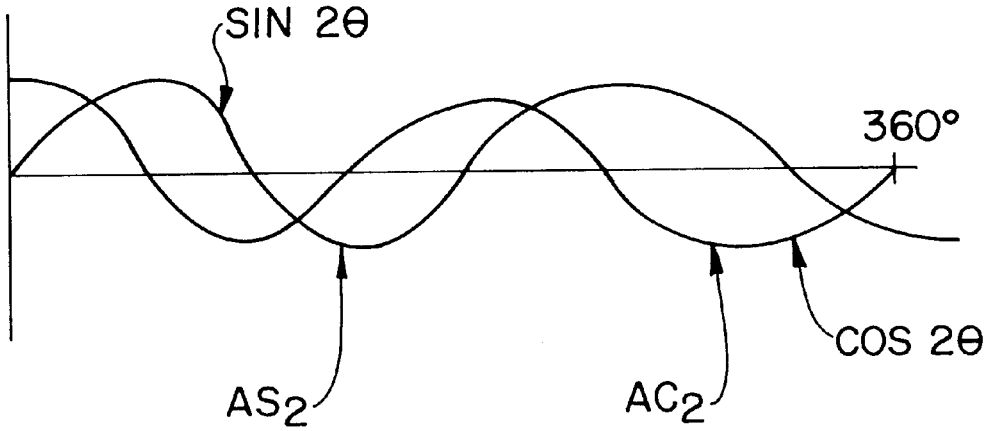

In the system in FIG. 1 the flow restricting valve 10 may be closed to push the system toward a rotating stall condition. It can be assumed that FIG. 3A is a map of static pressure around the annulus from the n static pressure sensors 29 during the rotating stall. This spatial pattern can be resolved into several Fourier coefficients, which identify the amplitudes of components associated with the sine $\theta$ and cosine $\theta$ patterns of n harmonic waveforms. It is well known that any periodic pattern can easily be resolved into its Fourier components. FIG. 3B and 3C show the waveforms associated with the first and second Fourier spatial harmonics respectively.

Figure 11A:
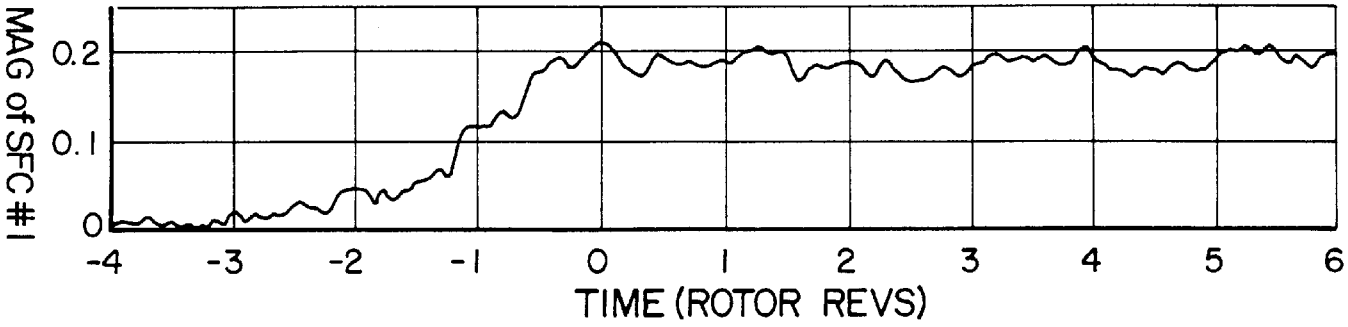
FIGS. 11A, 11B, 11C show the magnitudes of the first, second and third spatial Fourier coefficients as a function of time (measured in compressor revolutions) as the compressor transitions from axisymmetric flow into fully developed rotating stall.
Figure 11B:
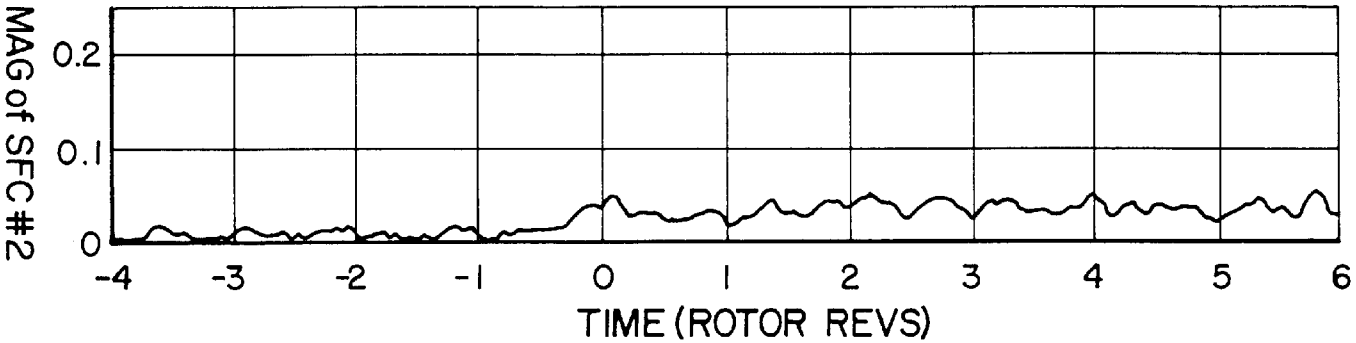
Figure 11C:
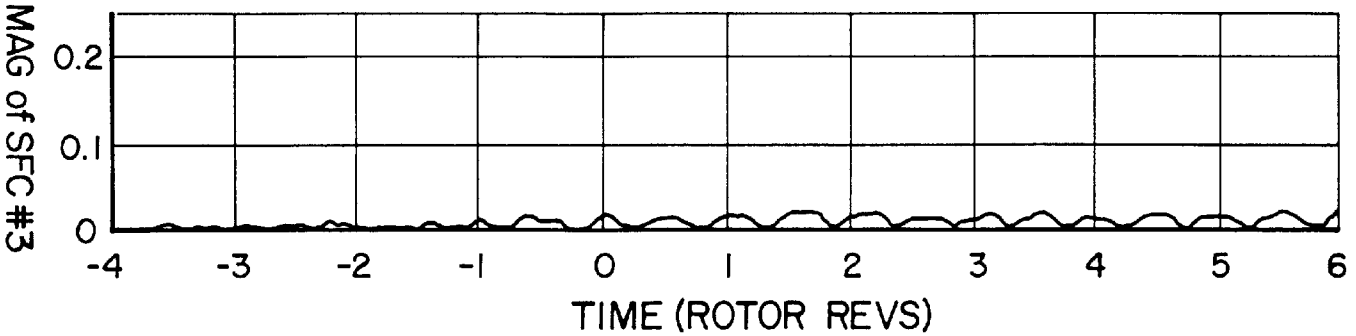

FIGS. 11A–C show typical values for the magnitudes of the first, second and third harmonics (SFC1, SFC2 and SFC3) for a typical transition into rotating stall. The preferred embodiment of the present invention uses the square of the amplitude of the first harmonic, shown in FIG. 11A, where it should be observed that |SFC1| reaches its maximum value within a few compressor revolutions (REVS)

without the control. Because any of the embodiments of the invention described above respond to the magnitude of signal in FIG. 11A, the magnitude of asymmetry with the stall controller operating is always substantially less, heuristically meaning that a performance limiting rotating stall cannot appear because the control will open the bleed valve sufficiently to reject the flow disturbance before there are enough revolutions to allow the stall cell to build.

Figure 8:
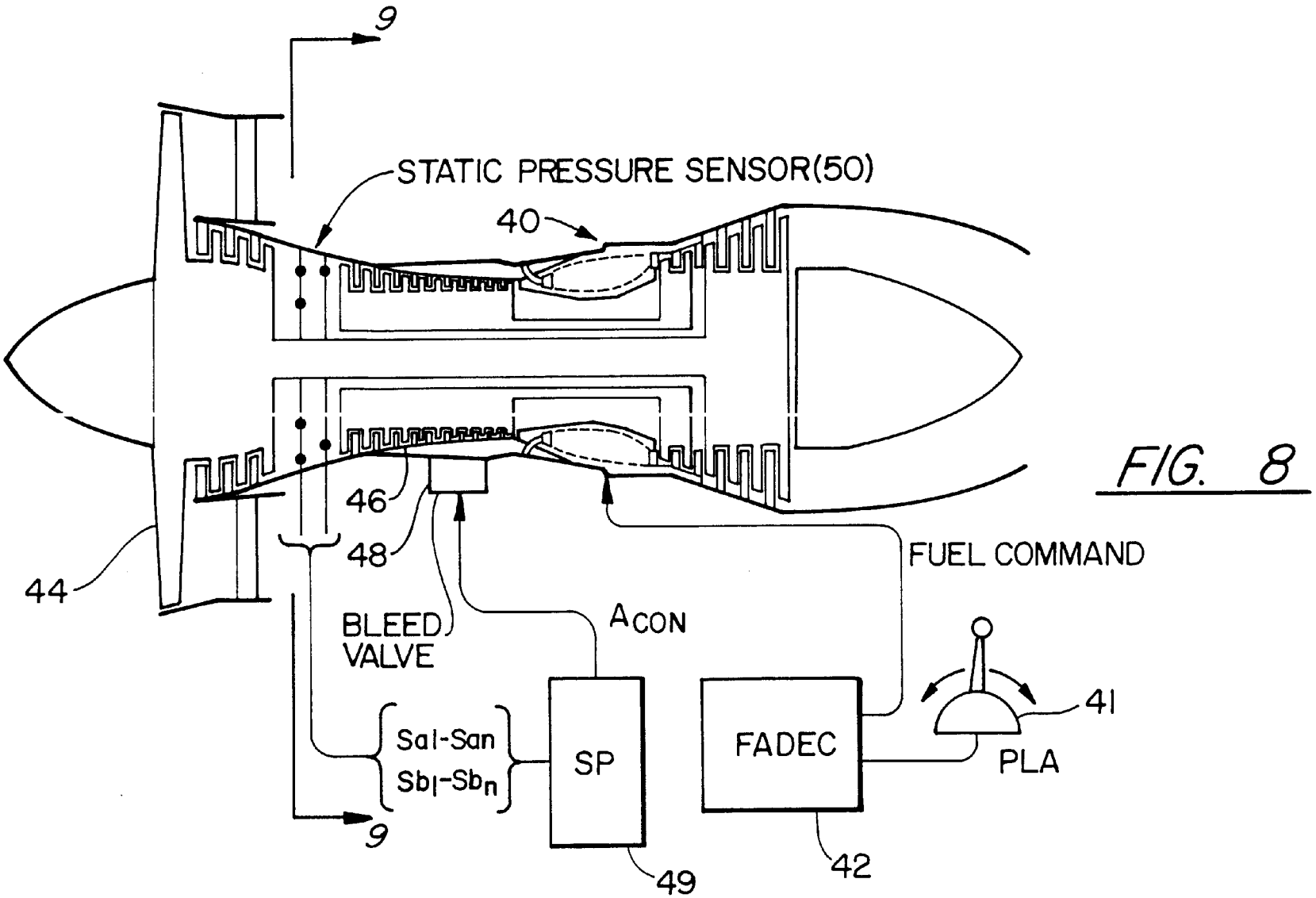
FIG. 8 is a functional block diagram showing a modem high bypass gas turbine engine having a stall/surge control system embodying the present invention.

Referring to FIG. 8, a modern high bypass gas turbine aero engine 40 is shown in which the invention can be used. The engine is typically controlled by Full Authority Digital Electronic Control (FADEC) 42. The FADEC controls fuel flow to the engine in a quantity that is a function of Power Lever Advance (PLA) and other engine operating conditions such N1, the speed of the fan 44 and the compressor speed N2. Other parameters such as inlet temperature and ambient pressure may be used to regulate the fuel flow. The engine has a compressor bleed valve 48. It may have several of these valves at different compressor stages. These valves are used for many purposes.

Figure 9:
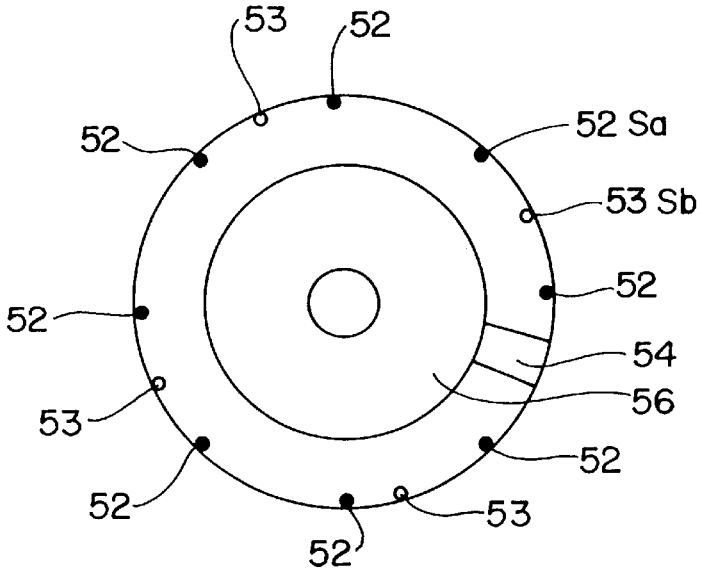
FIG. 9 is a section along line 9—9 in FIG. 8 and shows a plurality of static pressure sensors in the engine inlet before the compressor.

In this particular, application, the engine contains a plurality of static pressure sensors 50 at two axially spaced locations immediately in front of the high compressor. FIG. 9 illustrates a possible layout for these sensors. There 52 identifies the upstream static pressure sensors; 53 identifies the downstream static pressure sensors. The compressor blades (only one rotor blade is shown) are shown as number 54 and are attached to a disk 56. The sensors 28, 29 provide the signals Sa1-San and Sb1-Sbn to a signal processor(SP) 49, which produces the bleed control area signal $A_{con}$, which controls the servo controlled bleed valve 48. The signal processor is assumed to contain a computer and associated memory and input/output devices for carrying out control steps shown in FIG. 10, explained below.

Figure 10:
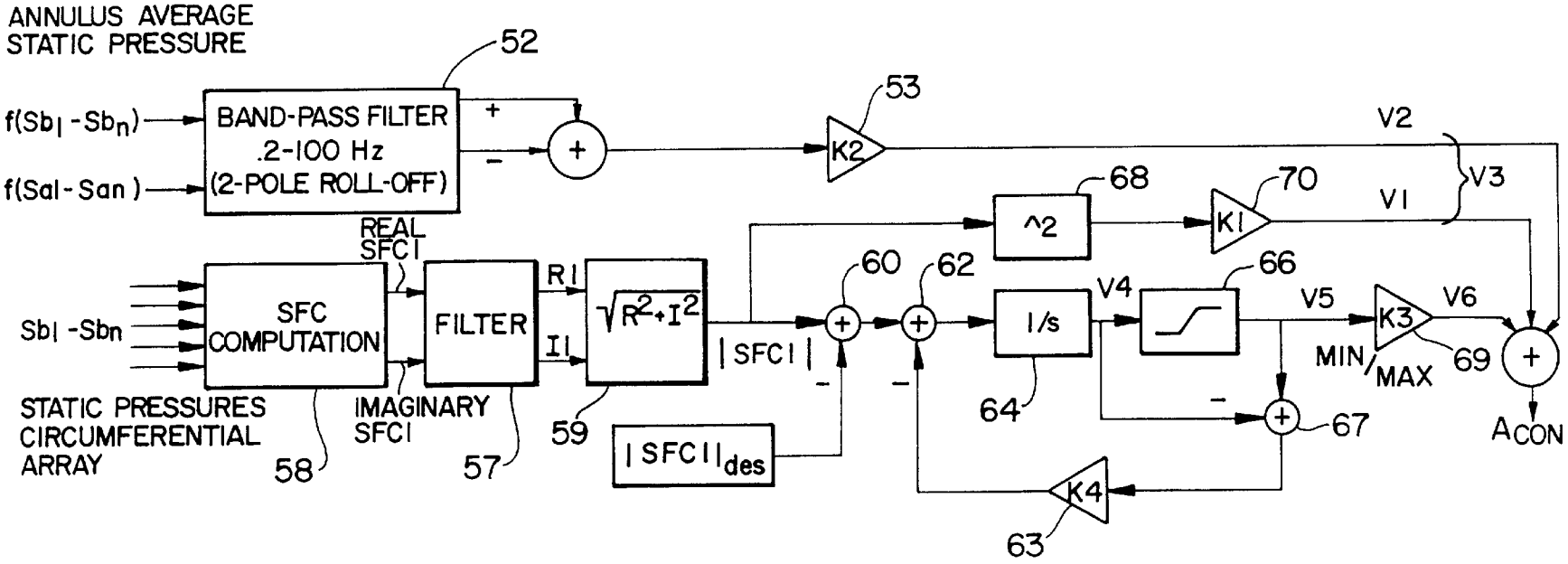
FIG. 10 shows the transfer functions for one embodiment of the present invention.

It was explained above that the bleed valve opening or area is determined from the magnitude of $\alpha$ ($|SFC1|^2$) and a value for the annulus average time rate of change of compressor flow $\delta$ and that, depending on the desired control stability, an additional integral term can be added the control function ($A_{con}=K_1\alpha+K_2\delta$). For instance, FIG. 10 shows an overall block diagram for generating the first two terms as values as V1, V2, from the static pressure arrays and that includes the described integration of the difference between actual and a preselected |SFC1| and limiting the integration value to a min or max level. The Annulus Average Static Pressures are a function of the outputs Sal-San and Sbl-Sbn are bandpass filtered at 52. Preferably the range of this filter is on the order of 0.01 to 1 times rotor rotational frequency. The summed output is an indication or manifestation of the time rate of change of mass flow (total flow). To produce the value V2, the above sum is multiplied by the scaling factor K2 at block 53.

The static pressure signals Sb l-Sbn are used in the SFC Computation block 58 to produce real and imaginary values of SFC1. The SFC value (spatial Fourier coefficient) is computed using well known mathematical techniques to resolve the pressure pattern (e.g. P(θ) in FIG. 3A) into its harmonic components, though only the first harmonic component SFC1 is used in this embodiment. The real and imaginary components for SFC1 are applied to a filter 57 to resolve the real R1 and imaginary I1 signals are used to define |SFC1|. The computation at block 59 determines the value of |SFC1| which is applied to the summing junction 60. |SFC1| is summed with the "design" (des) value at block 60 and then summed with a feedback value from K4 at block 62 and then integrated at block 64. The result from the integration at 64 is applied to a min/max limiter 66. The difference between V4 and V5 is determined at summer 67, the resultant error or difference being applied back after scaling K4 (block 63) to the summer 62, where it reduces the input to the integrator 64, thereby reducing the magnitude of V4 so that the actual value for V4 does not exceed the limit values. This effects the anti-windup function discussed above.

The value V5 is scaled by K3 at block 69 to produce the value V6. The third value V1 that is used to produce the commanded bleed area, is computed from |SFC1| by squaring that value at function block 68 and scaling it with coefficient K2 at block 70. V1, V2 and V6 are summed at 73 to produce actuator signal $A_{con}$ for driving the bleed valve 48.

Although the invention has been shown and described with respect to exemplary embodiments thereof, it should be understood by those skilled in the art that various changes, additions and combinations of the features, components and functions disclosed herein may be made without departing from the spirit and scope of the invention.

We claim:

1. A controller for a compressor, characterized by:

first means for sensing fluid flow properties in a fluid flow path around a compressor flow axis to produce first signals that manifest circumferential asymmetry of said fluid flow;

second means for providing a second signal that manifests the time rate of change of the mass flow of said fluid in the flow path;

signal processing means comprising means for a providing a first processor signal from said first signals with a value that manifests the magnitude of said circumferential asymmetry; and for adding said first processing signal with said second signal to produce a control signal; and third means for modifying said fluid flow as function of the magnitude of said control signal.

2. The controller described in claim 1, further characterized in that said first processor signal manifests the first spatial Fourier coefficient for said circumferential asymmetry.

3. The controller described in claim 2, further characterized in that said first processor signal manifests the square of the first spatial Fourier coefficient for said circumferential asymmetry.

4. The controller described in claim 2, further characterized in that said first means comprises a plurality of static pressure sensors located along the circumference of said flow path.

5. The controller described in claim 3, further characterized in that said second means comprises a total pressure sensor located in said flow path.

6. The controller described in claim 1, further characterized in that said signal processor comprises means for producing a second processor signal that manifests the integral of said first processor signal and for adding said first processor signal, said second processor signal and said second signal to produce said control signal.

7. The controller described in claim 1, further characterized in that said signal processor comprises means for producing a second processor signal that manifests the integral of the difference between said first processor signal and a stored value for said first processor signal and for adding said first processor signal, said second processor signal and said second signal to produce said control signal.

8. The controller described in claim 7, further characterized in that said signal processor comprises means for producing said second processor signal at a constant minimum value greater than or equal to zero when said integral is less than a first range of values and a constant first maximum value when said integral is greater than said first range of values.

9. The controller described in claim 6, further characterized in that said first processor signal manifests the first spatial Fourier coefficient for said circumferential asymmetry.

10. The controller described in claim 1, further characterized in that said value of said first signal manifests the square of a value for said circumferential asymmetry and said signal processing means comprises means for providing a second processor signal that manifests the integral of the difference between said value for said circumferential asymmetry and stored value for said circumferential asymmetry, and for adding said first processor signal, said second processor signal and said second signal to produce said control signal.

11. The controller described in claim 10, further characterized in that said first processor signal is the first spatial Fourier coefficient for said circumferential asymmetry.

12. The controller described in claim 11, further characterized in that said first means comprises a plurality of static pressure sensors located along the circumference of the flow path.

13. The controller described in claim 12, further characterized in that said second means comprises a total pressure sensor located in the flow path.

14. A controller for a compressor, characterized by:

a plurality of first probe means each for producing one of a plurality a first flow signals that manifests static pressure at an individual circumferential locations around compressor flow axis;

second probe means for providing a second flow signal that manifests the time rate of change of the mass flow of said liquid in the flow path;

signal processing means comprising means for providing an asymmetry signal from said first flow signals with a value that manifests the magnitude of circumferential asymmetry around said compressor flow axis; for a providing a first processor signal that manifests the square of said value; and for producing a control signal that manifests the sum of said first processor signal and said second signal; and means for reducing the value of said first asymmetry signal by altering the magnitude of mass flow in the compressor as function of the magnitude of said control signal.

15. The controller described in claim 14, further characterized in that said signal processing means comprises means for storing a first value that manifests a desired magnitude for said asymmetry signal; for providing a processor error signal that manifests the difference between the value of said asymmetry signal and said first value; for providing an integration signal by integrating said processor error signal; and for providing said control signal with a magnitude that manifests the sum of said first processor signal, said second signal and said integration signal.

16. The controller described in claim 15, further characterized in that said signal processing means comprises means for providing said integration signal by integrating said processor error signal to provide a second processor signal and selecting one of two stored values based on the magnitude of said second processor signal.

17. The controller described in claim 16, further characterized in that said asymmetry signal manifests the amplitude of the first spatial Fourier coefficient.

18. A gas turbine engine, characterized by;

first means for sensing airflow in a flow path around a compressor flow axis in the inlet to a compressor stage of the engine to produce a plurality of static pressure signals for different circumferential locations around the airflow path;

second means for providing a second signal that manifests a rate of change of the mass flow of said airflow;

signal processing means comprising means for providing an asymmetry signal from said static pressure signals, said asymmetry signal having a value manifesting the magnitude of circumferential asymmetry of said airflow around said axis; for providing a first processor signal that manifests the square of said asymmetry signal; and for adding said first processor signal with said second signal to produce a control signal; and third means for modifying said mass flow as function of the magnitude of said control signal to reduce the value of said asymmetry signal.

19. The gas turbine engine described in claim 18, further characterized in that said signal processing means comprises means for producing a second processor signal that manifests the integral of the difference between the value of said asymmetry signal and a stored value for said asymmetry signal; for producing said control signal with a value that manifests the sum of said first processor signal, said second processor signal and said second signal and for storing said stored value.

20. The gas turbine engine described in claim 19, further characterized in that said second signal processor signal has a first value when said integral signal is below a threshold value and a second value when said integral signal is above said threshold value.

21. A gas turbine engine having a rotary compressor with a compressor inlet and an engine control, characterized by:

a plurality of static pressure sensors located around the circumference of the compressor inlet each providing a static pressure signal for its location;

a total pressure sensor for providing a total pressure signal manifesting average total flow in the compressor;

said engine control comprising a signal processor for receiving each static pressure signal and said total pressure and for providing a flow asymmetry signal that manifests the first Fourier spatial coefficient for the flow asymmetry manifested by said static pressure signals; for providing a first processor signal that manifests the square of said asymmetry signal; for providing a time rate of change signal manifesting the time rate of change of said total pressure signal; and for providing a control signal that manifests the sum of said first processor signal and said time rate of change signal; and a compressor bleed valve for discharging compressor flow as function of the magnitude of said control signal to reduce the magnitude of said first signal.

22. A gas turbine engine having a rotary compressor with a compressor inlet and an engine control, characterized by:

a plurality of static pressure sensors located around the circumference of the compressor inlet each providing a static pressure signal for its location;

a total pressure sensor for providing a total pressure signal manifesting average total flow in the compressor;

said engine control comprising a signal processor for receiving each static pressure signal and said total pressure and for providing a flow asymmetry signal that manifests the first Fourier spatial coefficient for the flow asymmetry manifested by said static pressure signals; for storing a first value representing a desired magnitude for said flow asymmetry signal; for providing a first processor signal that manifests the square of said asymmetry signal; for providing a second processor signal that manifests the difference between said asymmetry signal and said first value; for providing a derivative signal manifesting the time rate of change of said total pressure signal; for integrating said second processor signal to produce an integration signal; for providing a control signal that manifests the sum of said first processor signal, said derivative signal and said integration signal; and a compressor bleed valve for discharging compressor flow as function of the magnitude of said control signal to reduce the magnitude of said first signal.

23. A method of controlling compressor fluid flow in a rotary compressor characterized by:

sensing compressor fluid flow static pressure at locations along the circumference of the fluid flow to produce first flow signals;

sensing axial mass flow to produce a second flow signal that manifests a time rate of change of the mass flow of said fluid in the flow path;

providing a first processor signal from said first signals with a value that manifests the magnitude of circumferential asymmetry of said fluid flow around said axis;

adding said first processor signal with said second signal to produce a control signal; and reducing the value of said first processor signal by altering the magnitude of said mass flow as function of the magnitude of said control signal.

24. The method described in claim 23, further characterized in that said first processor signal manifests the square of said magnitude of circumferential asymmetry.

25. The method described in claim 24, further characterized in that said magnitude of circumferential asymmetry is the first spatial Fourier coefficient.

26. The method described in claim 23, further characterized by producing a second processor signal that manifests the integral of said first processor signal and adding said first processor signal, said second processor signal and said second signal to produce said control signal.

27. The method described in claim 26, further characterized by providing said second processor signal by limiting said integral to a constant of zero or greater when said integral is less than a first range of values and to a constant maximum constant value when said integral is greater than said first range of values.

28. A stall and surge controller for a compression system, the compression system including a compressor with a flow path disposed about a flow axis, the controller including:

means for monitoring the flow through the compressor comprising:

means for sensing circumferential asymmetry of the fluid flowing within the flow path of the compressor to produce a parameter a that corresponds to the amount of asymmetry; and means for sensing perturbations in the time rate of change of mass flow throughout the flow path of the compressor to produce a parameter d that corresponds to the size of the perturbation; and actuation means for modifying the flow field within the flow path of the compressor responsive to the sum of a and d according to the control law comprising:

$$A=k_1\alpha+k_2\delta$$

where A corresponds to the amount of flow disruption produced by the actuation system, $k_1$ is a predetermined gain for the asymmetry parameter $\alpha$, and $k_2$ is a predetermined gain for the time rate of change of mass flow perturbation parameter $\delta$.

29. The controller according to claim 28, wherein the asymmetry parameter a is the square of the amplitude of the first spatial Fourier coefficient (|SFC1|) of the circumferential asymmetry of the flow properties within the flow path of the compressor.

30. The controller described in claim 28, wherein said control law is $A=k_1\alpha+k_2\delta+k_3\int(\alpha_k-\alpha)dt$, $\alpha_k$ being a stored value for $\alpha$ and $k_3$ is a predetermined gain.

31. The controller described in claim 28, wherein said term A is summed with an integral term $k_3\int(\alpha_k-\alpha)dt$, $\alpha_k$ being a stored value for $\alpha$ and $k_3$ is a predetermined gain, and said integral term having a preset minimum value and a preset maximum value.

32. The controller described in claim 31, wherein the value of $\alpha$ is adjusted to reduce the difference between the integral term and said preset maximum value.

* * * * *